United States Patent [19]

Adamek et al.

[11] 3,990,563

[45] Nov. 9, 1976

[54] SPOOL-EJECTING INK RIBBON DEVICE

[75] Inventors: Manfred Adamek, Wilnsdorf-Niederdielfen; Gerhard Hauptmann, Birken; Horst Würscher, Wilnsdorf, all of Germany

[73] Assignee: U.S. Philips Corporation, New York, N.Y.

[22] Filed: June 11, 1975

[21] Appl. No.: 585,956

[30] Foreign Application Priority Data

June 20, 1974 Germany ..... 2429703
Aug. 1, 1974 Germany ..... 2437065

[52] U.S. Cl. ..... 197/151; 197/165; 197/175

[51] Int. Cl.[2] ..... B41J 33/22

[58] Field of Search ..... 197/151, 160, 162, 165, 197/175

[56] References Cited

UNITED STATES PATENTS

| | | | |
|---|---|---|---|
| 2,654,461 | 10/1953 | Bovio | 197/165 |
| 2,902,136 | 9/1959 | Whippo | 197/165 |
| 3,481,445 | 12/1969 | Engle et al. | 197/151 |
| 3,587,813 | 6/1971 | Dugeny et al. | 197/162 |
| 3,621,969 | 11/1971 | Gotschewski | 197/165 |
| 3,675,753 | 7/1972 | Perucca | 197/18 |
| 3,882,989 | 5/1975 | Morelli | 197/151 |

FOREIGN PATENTS OR APPLICATIONS

| | | |
|---|---|---|
| 2,163,802 | 7/1973 | Germany |

*Primary Examiner*—Edgar S. Burr
*Assistant Examiner*—Paul T. Sewell
*Attorney, Agent, or Firm*—Frank R. Trifari; David R. Treacy

[57] ABSTRACT

An ink ribbon device having a holder for a ribbon spool which is pivotably mounted on a frame which supports the spool drive device. When the spool is inserted into the holder, a slide on the holder top is operated against the force of a spring, and engages guide slots. The holder then automatically is guided to the operating position and the spool engages the drive device. Upon movement of the holder for unloading, the spool is ejected by the spring.

7 Claims, 4 Drawing Figures

SPOOL-EJECTING INK RIBBON DEVICE

BACKGROUND OF THE INVENTION

1. Field of the Invention

The invention relates to an ink ribbon device having two holders for accommodating ink ribbon reels or spools, in which a drive pin of a drive device for the ink ribbon transport engages the reels in the operational condition.

2. Description of the Prior Art

German Auslegeschrift 2.163.802 describes a holder for accommodating a winding reel which can be slid into the slot of the holder. In order to achieve automatic connection to the drive device for the winding reel after insertion, the drive should elastically project into the rigidly mounted holder, so that it can be deflected for the winding reel. This mechanism is very expensive and susceptible to failure. Moreover, during insertion and removal of the reel the elastic forces always have to be overcome. If an ink ribbon reel is used as the winding reel, the operator unavoidably gets dirty hands when replacing the ink ribbon, because the operator is forced to put his fingers in the interior of the holder. Because the reel is rotatable in only one direction in this known device, other known mechanism, such as a sensor with reversing levers, etc. must be additionally provided for reversing the ink ribbon.

SUMMARY OF THE INVENTION

The object of the invention is to enable easy replacement of the ink ribbon reel without substantial effort and without requiring adherence to complex insertion instructions and to control the reversing of the ink ribbon using only a small force.

According to the invention a holder is pivotably mounted on a frame which supports the drive device. The holder includes a slide having a portion on one side which projects into the interior of the holder, and guided by projecting pins in guide slots in the frame. A ribbon spool when inserted into the holder, moves the slide against the force of a spring, the holder being automatically moved to the operating position by the pins and the guide slots so that the spool engages the drive device. Contrary to the prior art device described above, during the insertion of the ink ribbon reel into the holder the connection to the drive mechanism is made whether or not the mechanism is in the rest state. A further advantage is that an ink ribbon reel can be inserted and removed only when the holder is open. No special attention of the operator is required for replacing the ink ribbon. When the holders are opened to the loading position, both ink ribbon reels automatically slide out and can be removed. Special attention or special insertion instructions for the replacement of the ink ribbon are not required. The ink ribbon can even be inserted or replaced using only one hand.

The invention will be described in detail hereinafter with reference to a preferred embodiment of a device according to the invention.

The ink ribbon device with insertion mechanism for the ink ribbon reel, in which the connection to the drive means is automatically effected during insertion, includes a holder 1, in which an ink ribbon reel or spool 4 can be inserted, and a frame 2. The frame 2 is rigidly mounted on a machine in which the ribbon is to be used. The holder 1 is pivotable about an axis of rotation 3 in a portion of the frame.

Figure 2:
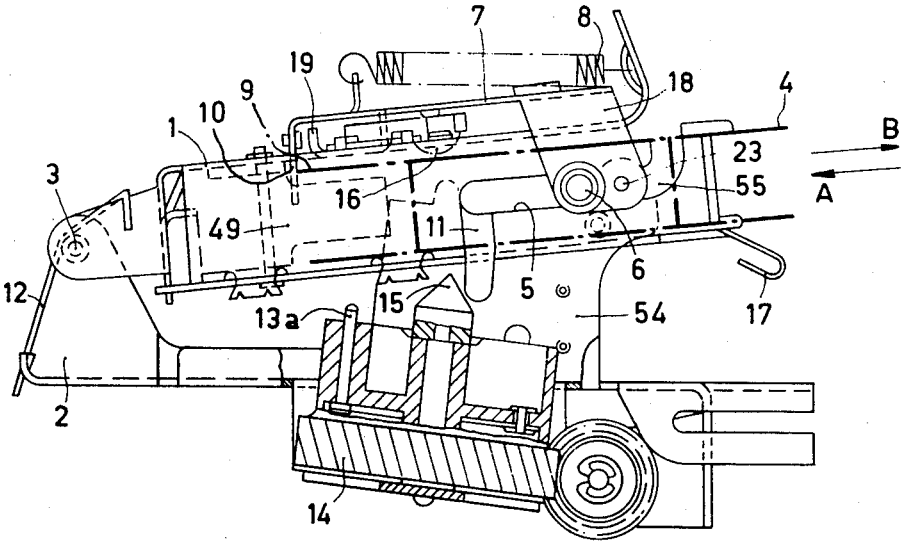
FIG. 2 is a partial sectional view of the holder of FIG. 1 in the loading position together with the drive device.

A slide 7 with a tensile spring 8 is mounted to be slidable on the top of the holder 1. This slide serves to slide the ink ribbon reel 4 outwards and at the same time to keep the holder open in the loading position. When the ink ribbon reel 4 is pressed inwards in the direction of the arrow A while the holder is in the loading position (FIG. 2), the slide 7 is pushed in a loading direction (the same direction as the spool moves) by a projection 10 which projects into the interior of the cassette 1 through a slot adjacent a side 9 of the reel body, the spring 8 then being tensioned. The slide 7 also has bent portions 18 which extend along the sides of the holder 1, the ends of the portion 18 accommodating pins 6 and 23. The pins 6 project outwards and slide over the top surface 5 of a portion 54 of the frame 2. These portions 54 have guide slots 11 which are curved, and extend transversely to an end of the surface 5, the center of curvature being located at the axis 3. The pins 23 project inwards, each pin sliding in a guide slot 55 of the holder 1. The length of this guide slot 55 corresponds approximately to the feed-in path of the ink ribbon reel 4 and guides the slide 7.

Figure 3:
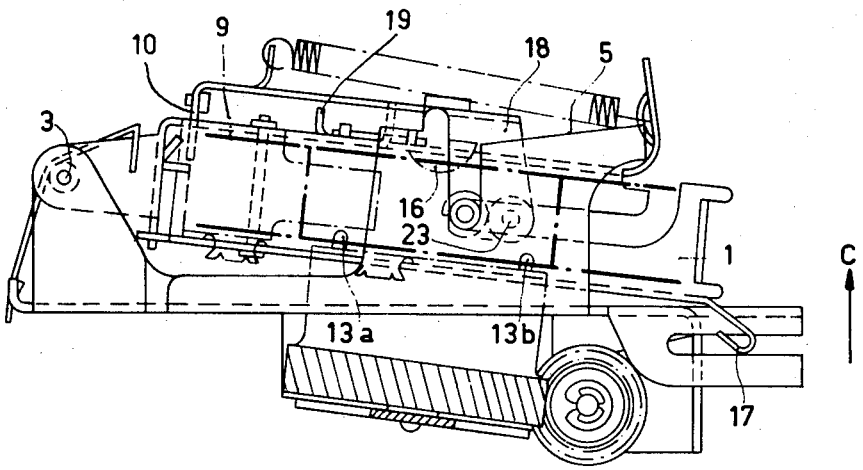
FIG. 3 shows the device of FIG. 2 in the operational position.

When the ink ribbon reel 4 is inserted into the holder 1, the slide 7 is taken along from the unloaded position by the ink ribbon reel 4. The pins 23 then slide in the slots 55 of the holder 1, until the pins 6 reach the guide slots 11 of the frame 2, and a path for the holder 1 in the downward direction is available. The slide is then in a loaded position. The pins 6 slide downward in the guide slots 11 under the influence of a pivot spring 12. The ink ribbon device is thus closed in the operational position (FIG. 3). In order to prevent dragging of the projection 10 on the ink ribbon reel 4 during operation due to action of the spring 8, the lower portions of the guide slots 11 are shaped, for example by further bending in the direction of the pivot 3, such that after engagement of the ink ribbon reel 4 on the drive pin 15 the slide 7 is moved slightly further against the force of the spring, with the result that the portion 10 is lifted off the edge 9 of the spool. The ink ribbon reel 4 can then rotate freely under the influence of the drive.

The drive for the reel is mounted on the frame 2. When the holder 1 is in the operational position, the ink ribbon reel 4 contacts two resilient pins 13a and 13b provided in a wheel 14 of synthetic material with inclined teeth. After rotation of the wheel 14 or of the ink ribbon reel body, the two pins 13a and 13b snap into holes provided in the reel body 4. For proper journalling of the reel body 4, a drive pin 15 is provided on the wheel 14 which, when the holder is in the operational position, projects into the interior of the holder and centers the ink ribbon reel 4. Opposite this drive pin, guide knob 16 is pivotably arranged on the top of the holder 1. In the operational condition of the device, the guide knob 16 and the drive pin 15 penetrate into the central opening of the reel body 4 and constitute a rotary axis.

When the holder 1 is lifted in the direction of the arrow C by means of the grip 17, the slide 7 is released after the departure of the pins 6 from the guide slots 11, the holder then being in the loading position; the slide 7 is then moved in the direction of the arrow B by the spring 8 to the unloaded position, the projection 10 then taking along the reel body 4. This movement of the slide is terminated by an abutment 19 on the top of the holder 1 which stops the projection 10 of the slide 7. The upper sides 5 of the frame 2, supporting the holder 1 by way of the pins 6, prevent the holder 1 from being closed to the operational position again so long as no other ink ribbon reel 4 has been inserted.

The upper guide knob 16 is connected to a lever 20 which is pivotably journalled about the shaft 21. A leaf spring 22 presses the guide knob 16 away from the reel body 4 when the holder is in the loading position. The reel body 4 is thus released by the guide knob 16, and has been released from the drive pin 15 by the upward movement of the holder 1. pin 15 by pivoting the cassette in the open condition. In the operational position of the holder, however, the outer end 24 of the lever 20 abuts against a rigid side 25 of a portion of the frame 2. The guide knob 16 is thus forced into the center of the reel body.

Figure 1:
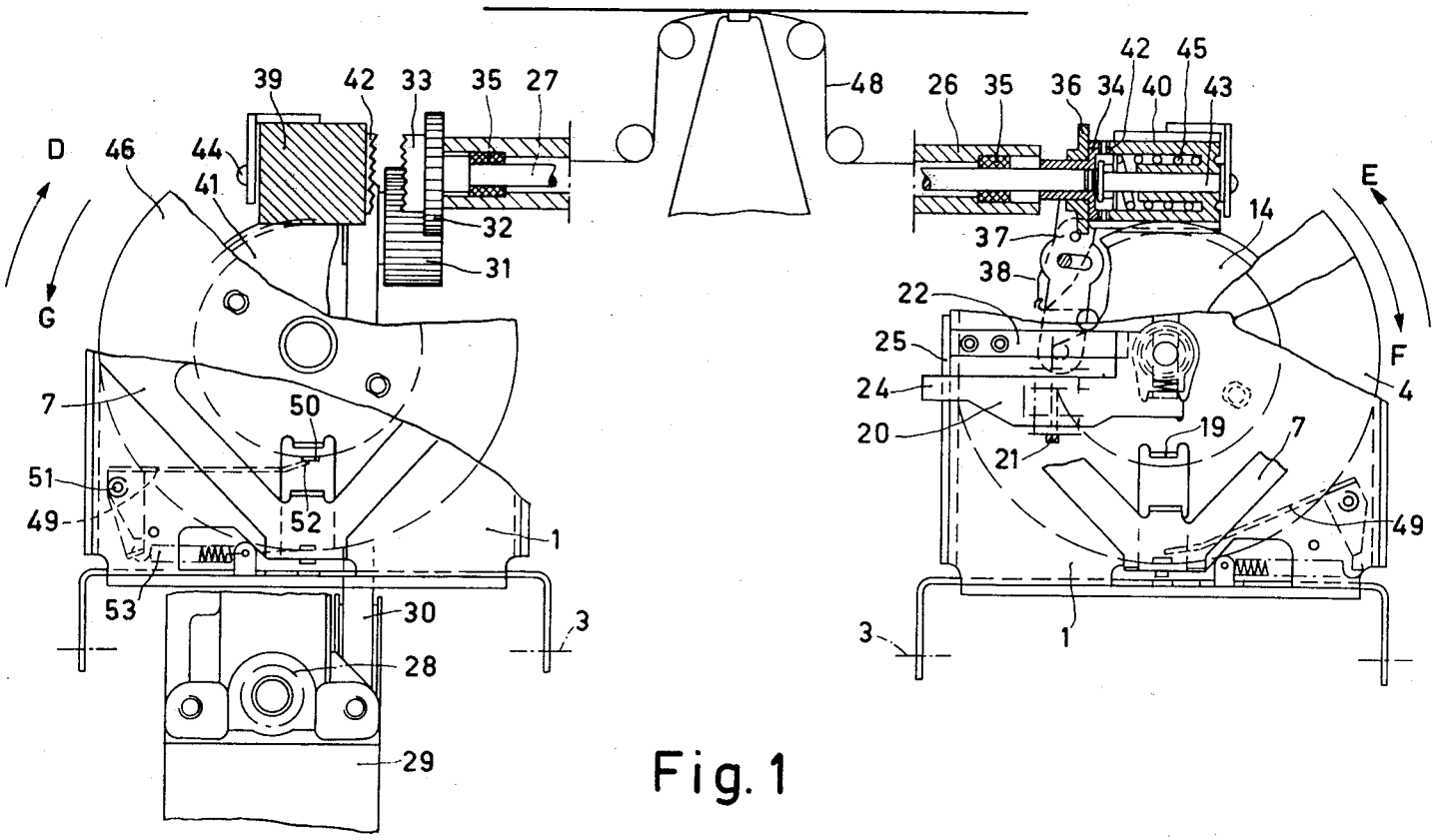
FIG. 1 is a plan view of an ink ribbon device according to the invention.

FIG. 1 also shows a drive mechanism for the two spools. A switching shaft 27 is arranged to be axially slidable and rotable in bearings 35 in a guide tube 26. This shaft 27 is driven by an electric motor 29 through the series of a drive 28, a toothed belt 30 and gearwheels 31 and 32. The electric motor 29 can be driven either continuously or only during writing. The gearwheel 32 is connected to the shaft 27 and is provided with a serrated clutch face 33 on the head side thereof. On the opposite side, a wheel 34 with opposite clutch serrations is rigidly connected on the shaft 27. Attached to the wheel is a guide ring 36 which freely rotates in a forked lever 37. The lever 37 is arranged as an over-center toggle using a spring 38 and has only two stable positions: a right position (shown in FIG. 1) and a left. The two helical gears 39 and 40 engage respective drive pins 15 by way of their counter wheels 14, and 41 and also have clutch serrations 42 on their head side. Each of these wheels 39 and 40 is journalled to be slidable on their own shaft 43 and 44. A compression spring 45 in each helical gear maintains the position of the wheels shown in FIG. 1. The two helical gear drives 39, 41 and 40, 14 act in opposite directions. They are correspondingly toothed considering the direction of rotation.

In operation, if the ink ribbon reel 46 shown at the left has been completely unwound, the two ink ribbon reels 46 and 4 can no longer rotate. In this condition the ink ribbon 48 is tensioned. Because of the helical toothing, the wheel 40 is then moved to the left, that is, it continues with a helical movement engaging the now stationary wheel 14. The associated spring 45 is then compressed, and presses the switching shaft 27 to the left, a sufficient distance that the over-center lever 37 acting on the ring 36 moves the shaft 27 to the stable left position, so as to engage the clutch serrations of opposite direction. In this position the helical gear 40 and clutch 42 are disengaged from the drive clutch 34, and return to the starting position under the influence of the spring 45, and subsequently rotate freely.

So as to avoid locking of the drive, the clutch serrations are arranged to have inclined surfaces, so that the drive can disengage itself. The arrows G and E indicate the winding direction, and the arrows D and F indicate the unwinding direction of the ink ribbon reels 4 and 46.

Figure 4:
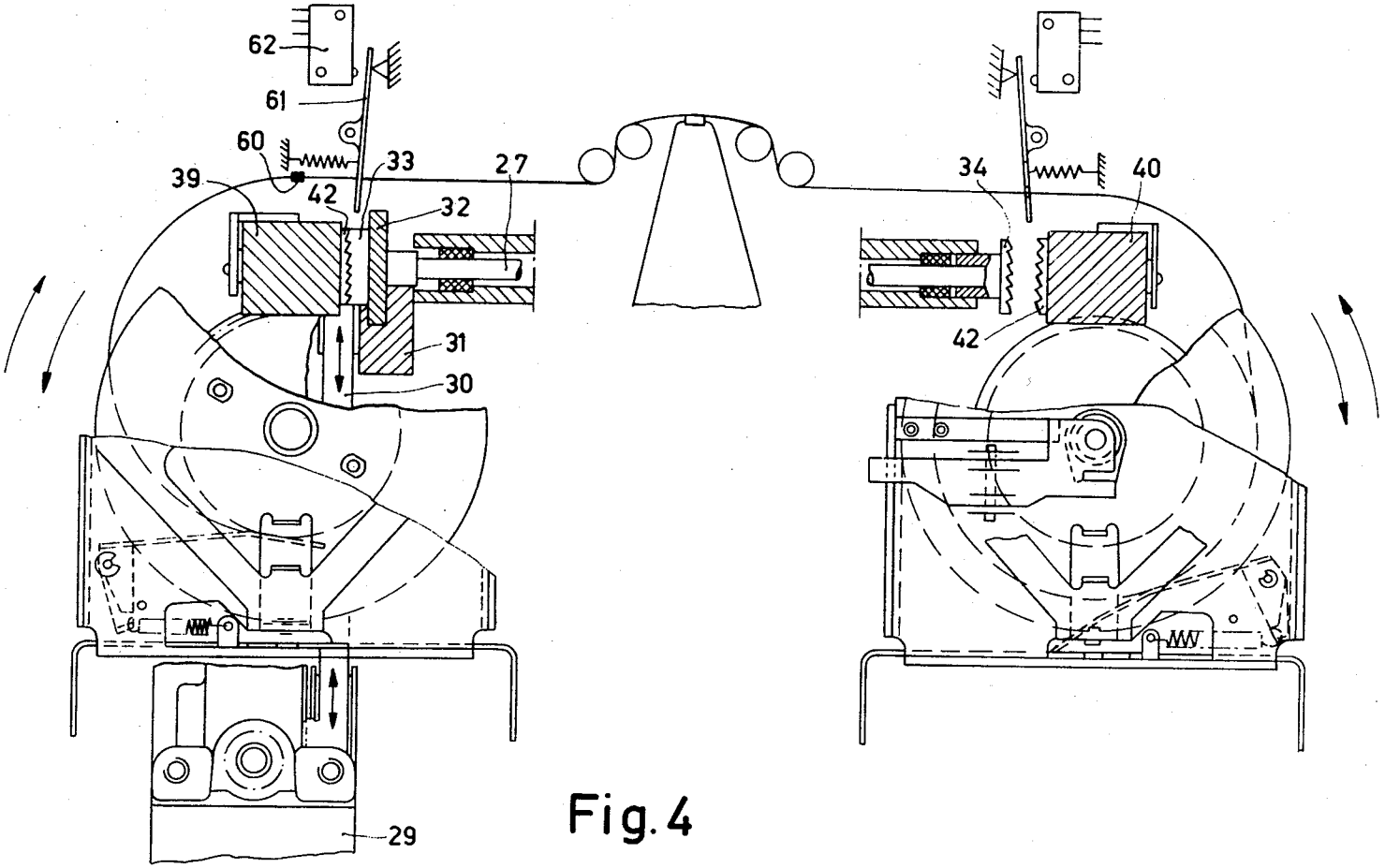
FIG. 4 is a plan view of another embodiment of an ink ribbon device.

In this embodiment, the direction of rotation is thus reversed on the basis of the increasing tensile force in the ink ribbon, the motor continuing to rotate in the same direction. The increasing tensile force in the ink ribbon may be detrimental to the service life thereof, and the printing of the characters to be written can be also adversely affected thereby. These drawbacks are eliminated in the embodiment of the automatic ink ribbon device shown in FIG. 4. This device substantially corresponds to the device shown in FIG. 1, the difference being that now the counter wheels 39 and 40 are rigidly mounted on their respective shafts, the switching shaft being driven by a reversible electric motor 29 which, through a toothed belt 30, drives a gearwheel 31 having teeth inclined at an angle of 45°. This gearwheel 31 cooperates with a gearwheel 32 which is also provided with teeth inclined at an angle of 45° and which is rigidly mounted on the shaft 27.

Depending on the direction of rotation of the toothed belt 30, the inclined toothing of the wheels 31 and 32 slides the shaft 27 to the left or right so that one or the other serrated clutches is engaged. The sliding of the switching shaft 27 is then effected by the motor 29 itself, so that the ink ribbon is not loaded. When the ink ribbon has been unwound on one side, for example, on the left-hand side of FIG. 4, an abutment 60 of any well-known type fastened to the tape near its end switches over a lever 61 against contact 62, so that the direction of rotation of the motor 29 is reversed. Other switch-over systems are alternatively possible. A very simple reversal of the transport direction of the ink ribbon is thus achieved.

What is claimed is:

1. A ribbon supply device for ribbon wound on a spool about an axis, comprising a frame, means for holding a spool in an operational position with respect to said frame, and drive means for rotating a spool held in the operational position, wherein said holding means comprises:

a holder pivotably mounted to said frame for movement between a loading position and an operational position, in said loading position said holder arranged to permit insertion of a spool therein in a direction perpendicular to its axis;

a slide mounted to said holder for sliding movement in a direction parallel to the insertion direction of the spool, said slide having a projection projecting into an interior region of said holder for engaging a spool being inserted for movement of the slide in a loading direction from an unloaded to a loaded position;

resilient means for biasing said slide in a direction opposite to said loading direction;

means for permitting movement of said holder from said loading position to said operational position only while said slide is in said loaded position; and means for permitting movement of said slide between the loaded and unloaded positions only while said holder is in the loading position.

2. A device as claimed in claim 1 comprising means for disengaging said projection from engagement with the spool while the holder is in the operational position.

3. A device as claimed in claim 1, wherein said means for permitting comprises a surface on said frame and a slot in said frame extending transversely from said surface, and a projecting member on said slide arranged to engage said surface, the holder being in the loading position, and to engage said slot, the holder being in the operational position.

4. A device as claimed in claim 3, wherein said slot further comprises a portion shaped such that engagement of said projecting member with said portion moves said slide a further distance in said loading direction and disengages the projection from the spool upon completion of movement of the holder from the loading to the operational position.

5. A device as claimed in claim 3, wherein said drive means comprises a drive pin arranged to engage and center a spool in the operational position, and said holder comprises a guide and means for moving said guide so as to project resiliently into the interior of the holder opposite the drive pin when said holder is moved from the loading to the operational position.

6. A device as claimed in claim 3, further comprising a spring biasing said holder from the loading to the operational position, whereby upon insertion of a spool a distance sufficient to move the slide to the loaded position, the holder is moved by said spring to the operational position.

7. A device as claimed in claim 3, comprising two holders for accepting one spool in each holder, and means for guiding a length of tape along a path between the spools, said drive means being alternatively engageable to drive one spool while ribbon is paid out from the other spool.

* * * * *